United States Patent [19]

Morishita et al.

[11] Patent Number: 4,852,208

[45] Date of Patent: Aug. 1, 1989

[54] VACUUM CLEANER

[75] Inventors: Takuya Morishita, Himeji; Atushi Okuda; Shinji Asanaka, both of Kasai, all of Japan

[73] Assignee: Sanyo Electric Co., Ltd., Japan

[21] Appl. No.: 254,434

[22] Filed: Oct. 6, 1988

[30] Foreign Application Priority Data

| | | | |
|---|---|---|---|
| Oct. 8, 1987 | [JP] | Japan | 62-253986 |
| Oct. 13, 1987 | [JP] | Japan | 62-257816 |
| Oct. 16, 1987 | [JP] | Japan | 62-262237 |

[51] Int. Cl.[4] ..... A47L 9/00

[52] U.S. Cl. ..... 15/339; 15/257 B

[58] Field of Search ..... 15/339, 257 B

[56] References Cited

U.S. PATENT DOCUMENTS

| | | | |
|---|---|---|---|
| 2,632,912 | 3/1953 | Cuddeback | 15/339 X |
| 2,648,396 | 8/1953 | Kirby | 15/339 X |
| 3,975,790 | 8/1976 | Patterson | 15/339 X |
| 4,485,519 | 12/1984 | Collier | 15/339 X |

*Primary Examiner*—Chris K. Moore

*Attorney, Agent, or Firm*—Darby & Darby

[57] ABSTRACT

A vacuum cleaner comprising a cleaner body having a dust chamber formed with a suction opening and a fan chamber, the fan chamber having an air discharge opening, and drive control circuit for controlling the operation of the fan, the cleaner body being provided with an air channel in its interior for holding a portion of the fan chamber at the air discharge side of the fan in communication with the dust chamber and a shutter plate for closing the suction opening of the dust chamber, organism killing operation means for driving the fan after the cleaning operation to cause air to flow through the dust chamber, the fan chamber and the air channel into the dust chamber in circulation by the action of the closure means and kill noxious small organisms in the dust trapped in the dust chamber by heating.

18 Claims, 20 Drawing Sheets

VACUUM CLEANER

BACKGROUND OF THE INVENTION

1. Field of the Invention

The present invention relates to a vacuum cleaner, and more particularly to a vacuum cleaner having means for killing noxious small organisms, such as mites, trapped in the dust chamber of the cleaner body.

2. Description of the Prior Art

The noxious small organisms, such as mites, drawn into the dust chamber of the body of a vacuum cleaner along with dust during cleaning are separated off by a filter within the dust chamber without being discharged from the cleaner but are likely to proliferate in the chamber, so that they must be killed completely. It is known that mites and like noxious small organisms are killed when exposed to hot air of about 50° C. FIG. 24 shows a known vacuum cleaner which is so adapted. Further Unexamined Japanese Patent Publication SHO No. 62-127026 discloses a cleaner of similar construction. The vacuum cleaner shown in FIG. 24 is so adapted that a suction hose 51 inserted in the suction opening of its body case 50 is connected at its forward end to a discharge air cutlet 53 of the body case 50 for an electric fan 52 to circulate a hot discharge air stream from the fan 52 through a dust case 54 by way of the suction hose 51 and to thereby kill the mites and like noxious small organisms within the case 54.

Thus, the body case 50 of the conventional cleaner must be provided at its discharge side with the discharge air outlet 53 which is small and serves also as a socket for connection to the suction hose 51. Further when mites and like noxious small organisms are to be killed, the elongated suction hose 51 must be manually set in position, while the hose 51 extending outward from the body case 50 will bend or hang down, rendering the case 50 unstable. The dust case 54 can not be heated efficiently and requires a prolonged period of time for heating since the discharge air circulates through the elongated suction hose.

SUMMARY OF THE INVENTION

The present invention provides a vacuum cleaner comprising a cleaner body having a dust chamber formed with a suction opening and a fan chamber communicating with the dust chamber and accommodating an electric fan therein, the fan chamber having an air discharge opening, and drive control means for controlling the operation of the fan, the cleaner body being provided with an air channel in its interior for holding a portion of the fan chamber at the air discharge side of the fan in communication with the dust chamber and closure means for closing the suction opening of the dust chamber, the drive control means comprising cleaning operation means for driving the fan to thereby draw dust collecting air into the suction opening, pass the air through the dust chamber and the fan chamber and discharge the air from the discharge opening for a cleaning operation, and organism killing operation means for driving the fan after the cleaning operation to cause air to flow through the dust chamber, the fan chamber and the air channel into the dust chamber in circulation by the action of the closure means and kill noxious small organisms in the dust trapped in the dust chamber by heating.

Thus, the cleaner body of the present invention is internally provided with an air channel for holding the fan chamber in communication with the dust chamber and also has closure means for closing the suction opening of the dust chamber. By virture of this construction, the cleaner is adapted to perform the usual cleaning operation and also to operate for killing noxious small organisms (such as mites including Ornithonyosus, Demodex and Pediculoides, ticks, ants, etc.) in the dust collected in the dust chamber by heating the organisms, efficiently within a short period of time, with these two modes only by controlling the operation of the electric fan and by the action of the closure means.

The usual cleaning operation is performed by the cleaning operation means which drives the fan to draw dust collecting air into the suction opening, pass the air through the dust chamber and the fan chamber and discharge the air from the discharge opening. For example, this means comprises a power supply circuit for driving the fan, and a cleaning operation switch for energizing and deenergizing this circuit.

On the other hand, the organism killing operation is performed by the organism killing operation means, which drives the fan after the cleaning operation to cause air to flow through the dust chamber, the fan chamber and the air channel into the dust chamber in circulation by the action of the closure means. For example, this means comprises the above-mentioned power supply circuit for driving the fan, and an organism killing operation switch for energizing and deenergizing the circuit. Preferably, the circuit is deenergized automatically in response to a rise in the internal temperature of the dust chamber or in accordance with the duration of the operation instead of manipulating the switch.

From another viewpoint, the present invention provides a vacuum cleaner which comprises a cleaner body having a dust chamber formed with a suction opening and a fan chamber communicating with the dust chamber and accommodating an electric fan therein, the fan chamber having an air discharge opening, a hot air supply unit fittable to the suction opening for supplying hot air to the dust chamber, and drive control means for controlling the operation of the fan and the hot air supply unit, the drive control means comprising cleaning operation means for driving the fan to thereby draw dust collecting air into the suction opening, pass the air through the dust chamber and the fan chamber and discharge the air from the discharge opening for a cleaning operation, and organism killing operation means for driving the hot air supply unit as fitted to the suction opening after the cleaning operation to supply hot air to the interior of the dust chamber and kill noxious small organisms in the dust trapped in the dust chamber by heating.

According to the invention, the noxious small organisms in the dust trapped in the dust chamber can be heated and thereby killed efficiently and rapidly merely by fitting the hot air supply unit to the suction opening for supplying hot air to the interior of the chamber.

The cleaner of the invention is operated for cleaning in the usual manner by the same means as the foregoing cleaning operation means. On the other hand, the organism killing operation is performed by the organism killing operation means for driving the hot air supply unit as fitted to the suction opening after the cleaning operation to supply hot air to the interior of the dust chamber. When the hot air supply unit comprises a tubular member fittable to the suction opening for guiding outside air into the dust chamber, and a heater provided inside the tubular member, the organism killing operation means comprises, for example, a power supply circuit electrically connectable to the heater when the tubular member is fitted to the suction opening and also adapted to drive the fan, and a controlling operation switch for energizing and deenergizing the power supply circuit. As in the foregoing case, the circuit is deenergized preferably automatically. The hot air supply unit can be an assembly comprising a mount member fittable to the suction opening, a heater incorporated in the mount member and electrically connectable to the power supply circuit for driving the fan when the member is fitted to the opening, and a small-sized electric fan similarly incorporated in the mount member for supplying the heat of the heater to the dust chamber.

BRIEF DESCRIPTION OF THE DRAWINGS

FIG. 1 is a front view partly in section and showing the embodiment;

FIG. 2 is a perspective view of the same;

FIG. 3 is a plan view partly in section and showing the same;

FIG. 4 is a front view partly in section and showing the same in cleaning operation;

FIG. 5 is a fragmentary perspective view showing the same with a cover opened;

FIG. 6 is a diagram showing the electric circuit diagram of the same;

FIG. 7 is a front view partly in section and showing the embodiment;

FIG. 8 is a perspective view;

FIG. 9 is a plan view partly in section and showing the embodiment;

FIG. 10 is an enlarged fragmentary view in section of FIG. 7;

FIG. 11 is a front view partly in section and showing the embodiment during cleaning operation;

FIG. 12 is a fragmentary plan view showing the same with a shutter plate opened;

FIG. 13 is a fragmentary perspective view of a suction hose;

FIG. 14 is a perspective view of the lower portion of a plug member;

FIG. 15 is an electric circuit diagram;

FIG. 16 is a front view partly in section and showing the embodiment;

FIG. 17 is a perspective view;

FIGS. 18 (*a*) and (*b*) are respectively a front view and a view in vertical central section both showing a hot air supply unit;

FIG. 19 is an electric circuit diagram;

FIG. 20 is a fragmentary plan view showing the construction of a suction opening portion;

FIG. 21 is a perspective view showing the embodiment in cleaning operation;

FIG. 22 is a diagram showing the electric circuit of the same during cleaning operation;

Figure 1:
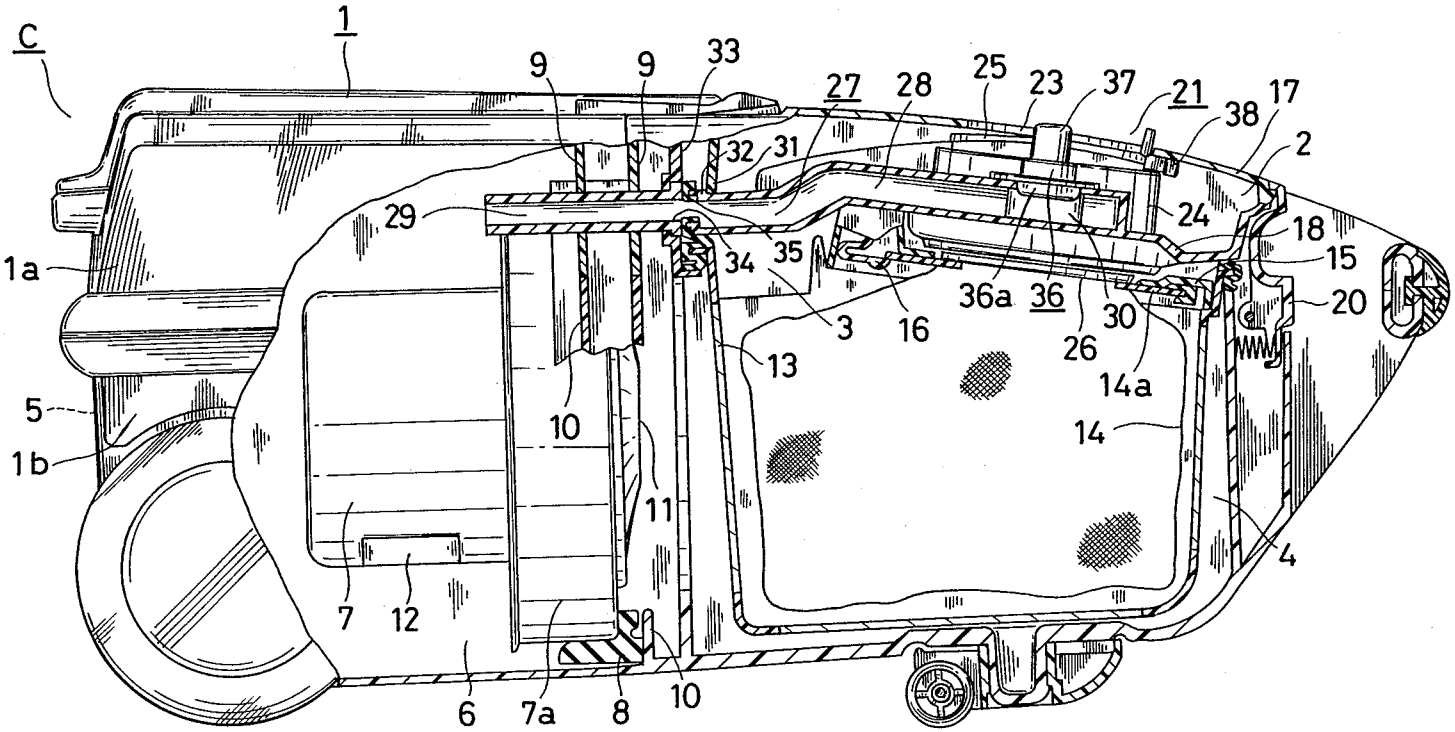
FIGS. 1 to 6 show a vacuum cleaner embodying the invention.
Figure 2:
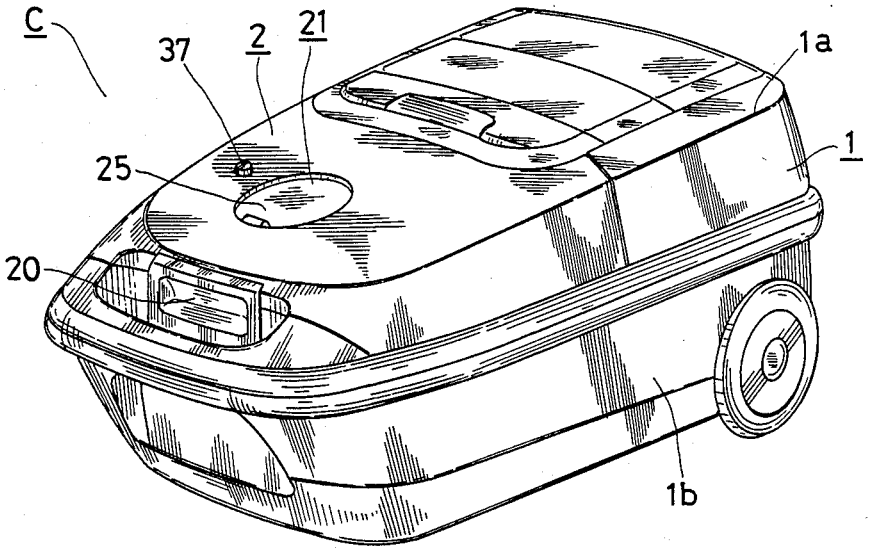
Figure 3:
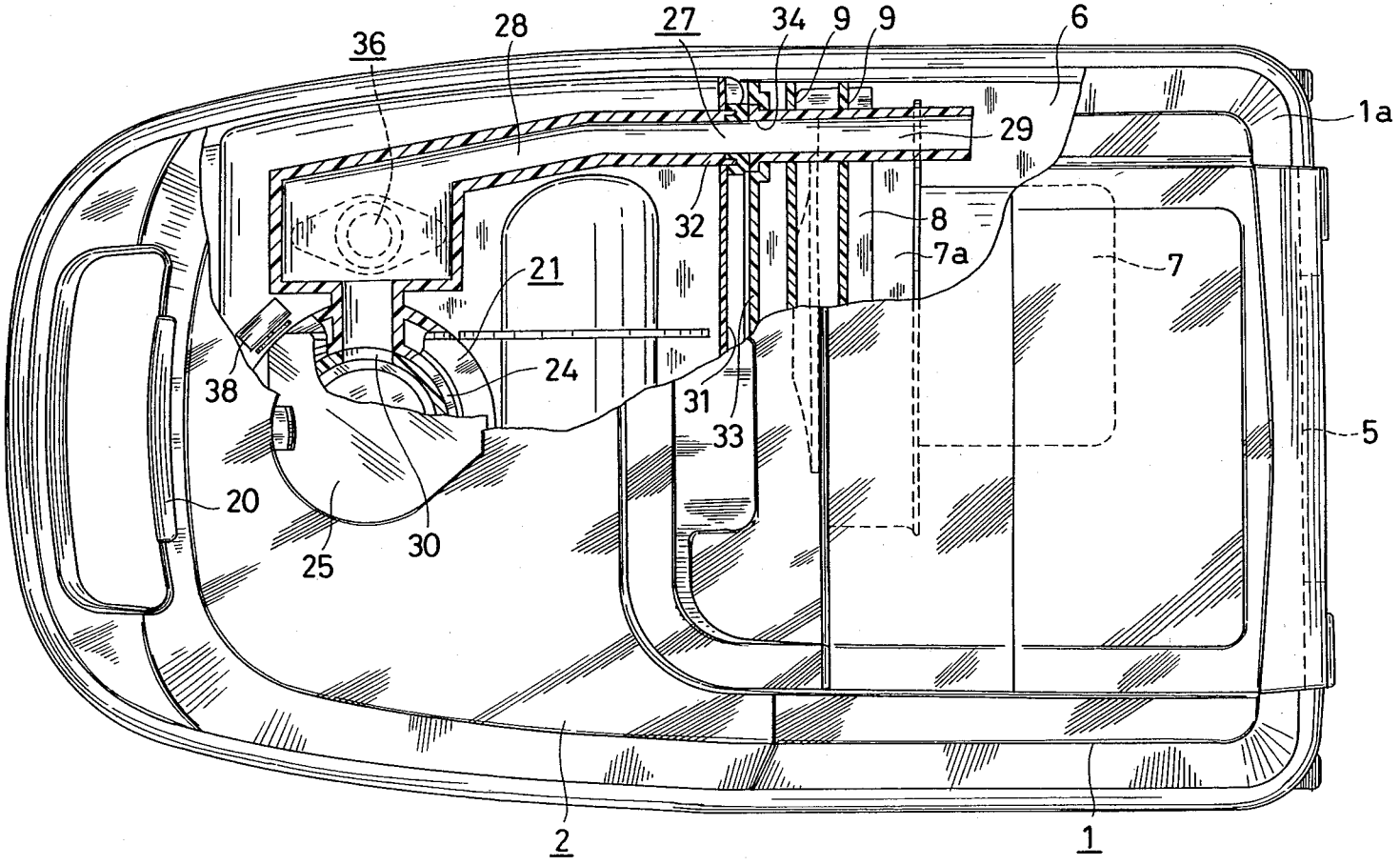

DESCRIPTION OF THE PREFERRED EMBODIMENTS (1) The construction of a vacuum cleaner C embodying the invention will be described with reference to FIGS. 1 to 6.

The cleaner C has a body case 1 comprising an upper case member 1*a* and a lower case member 1*b*. The case 1 has in its front portion a dust chamber 4 formed with an upper opening 3 which is closed with a cover 2, and in its rear portion a fan chamber 6 communicating with the dust chamber 4 and formed with an air discharge opening 5.

An electric fan 7 accommodated in the fan chamber 6 has a front fan case 7*a* which is held between an upper support rib 9 on the upper case member 1*a* and a lower support rib 10 on the lower case member 1*b*, with an annular cushion 8 provided between the case 7*a* and the ribs. The fan case 7*a* thus fixedly provided separates the chamber 6 into a suction side 11 and an air discharge side.

A box-shaped filter 13 having air permeability and shape retentivity to serve as a dust collecting filter is accommodated in the dust chamber 4 and is removable through the upper opening 3. The filter 13 has removably accommodated therein a disposable paper bag filter 14 serving also as a dust collecting filter. The filter 14 comprises a paper bag having air permeability but not permitting passage of noxious small organisms such as mites therethrough. Indicated at 15 is a frame for holding an opening plate 14*a* of the bag filter 14, and at 16 a clamp for engaging the opening plate 14*a*. The holding frame 15 rests on the opening edge of the box-shaped filter 13.

The cover 2 has a double-wall structure comprising an outer cover member 17 and an inner cover member 18. The cover has a rear portion pivoted to the upper case 1*a* and is biased in an opening direction at all times by a spring 19 (see FIG. 4). The cover has its front end engaged by a clamp member 20 provided on the lower case 1*b* to hold the upper opening 3 closed.

The cover 2 is provided with a suction opening portion 21 for connecting a suction hose 22 (see FIG. 4) to the cleaner C. The opening portion 21 has a suction opening 23 formed in the outer cover member 17 and comprises a hose socket 24 positioned under the opening 23 and interposed between the outer and inner cover members 17, 18, and a slidable shutter plate 25 serving as closure means for openably closing the upper end of the hose socket 24. A packing 26 provided under the hose socket 24 is hermetically in pressing contact with the opening plate 14*a*.

Figure 4:
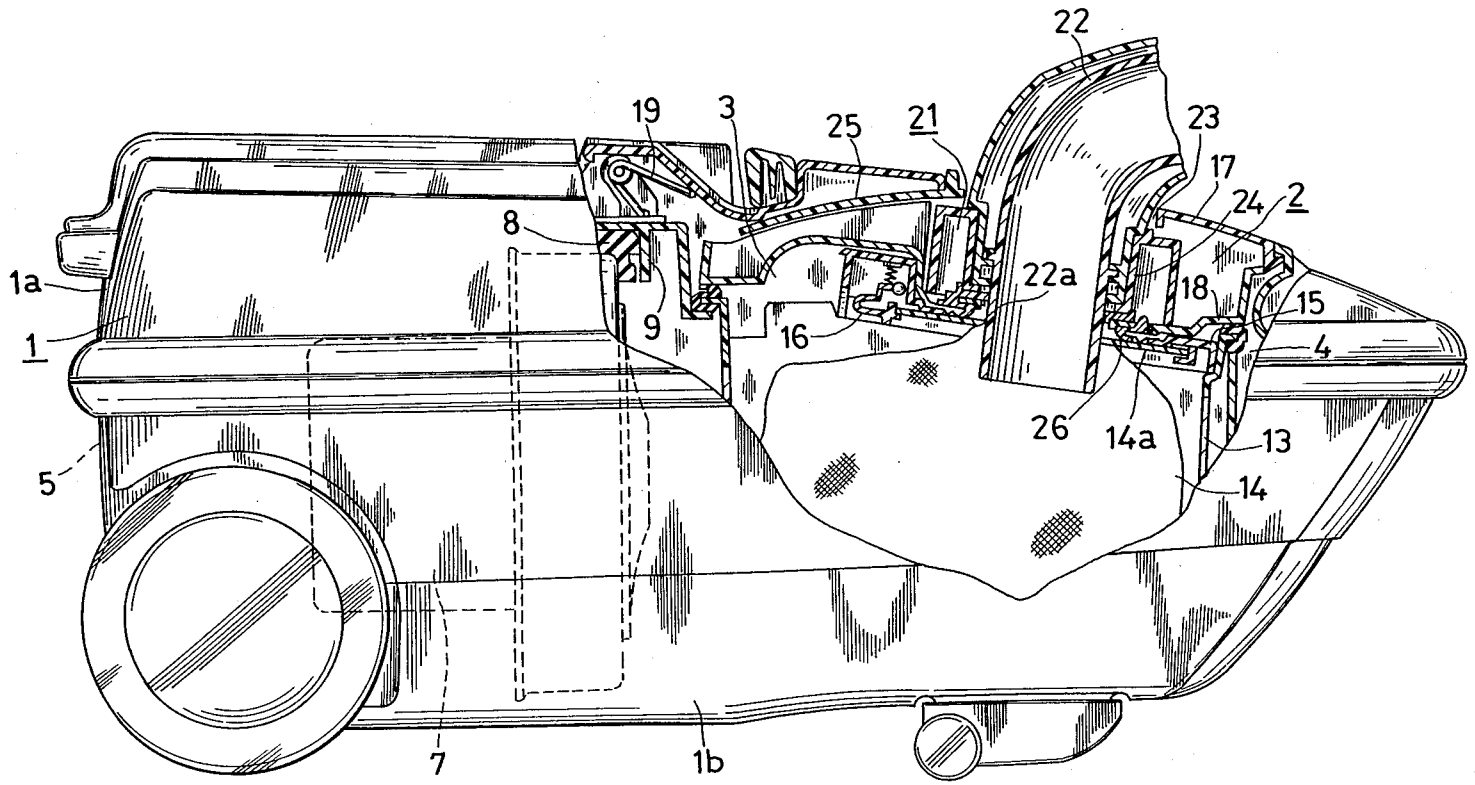
Figure 5:
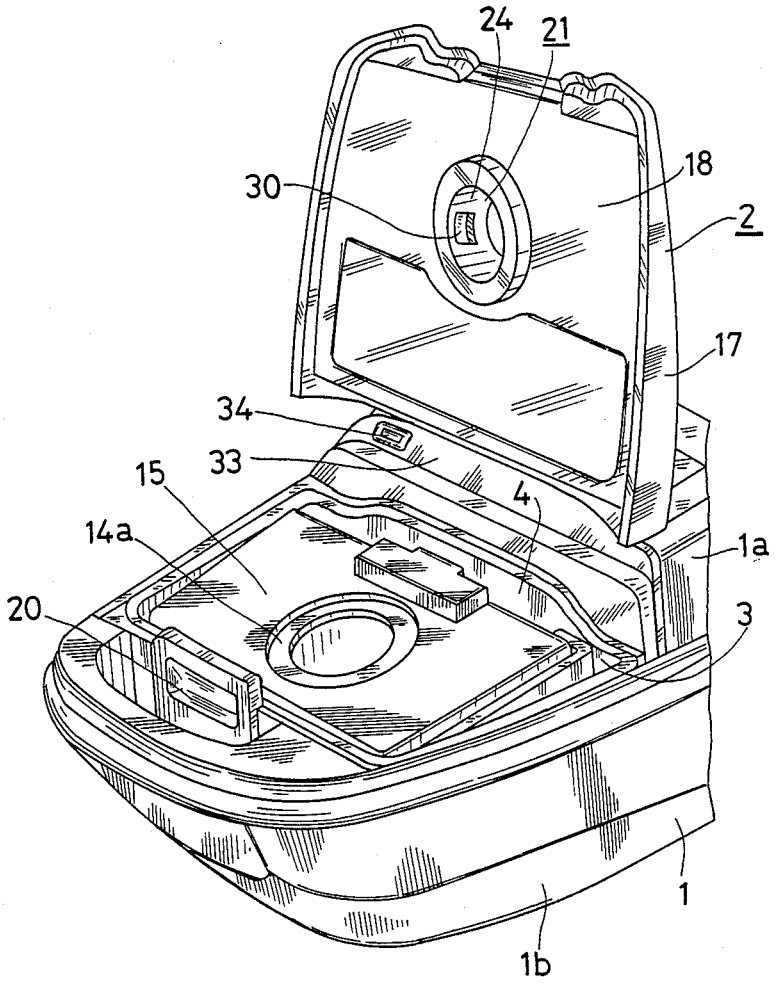

Indicated at 27 is an air channel provided within the cleaner body, whereby a discharge air stream from the fan 7 is circulated through the dust chamber 4. The air channel 27 comprises a cover channel portion 28 and a body channel portion 29. The cover channel portion 28 is provided between the outer and inner cover members 17 and 18, and has one end communicating with an air outlet 30 formed in a side portion of the hose socket 24. The other end of the channel portion 28 is projected from the rear end 31 of the cover 2 opposed to a portion 33 of the body case 1 to provide an air inlet 32. The air outlet 30 is closed when a connection tube 22*a* of the suction hose 22 is inserted in the socket 24 as seen in FIG. 4, whereas the outlet 30 is left open when the tube 22*a* is not inserted.

The body channel portion 29, which is provided in the body case 1, extends from the discharge side 12 of the fan 7 forward through the upper support rib 9 and has an air outlet 34 in the body portion 33 opposed to the air inlet 32. The air inlet 32 is provided with a seal packing 35 which, when the cover 2 is closed, seals off the junction between the inlet 32 and the outlet 34, hermetically holding these portions in communication with each other.

The cover channel portion 28 is provided with a temperature sensor switch 36 and disposed in the vicinity of the suction opening portion 21. The switch 36 has a reset button 37 projecting outward from the outer cover member 17 in the vicinity of the suction opening portion 21. The switch 36 is turned on by depressing the reset button 37 and is turned off upon the sensor portion 36*a* thereof detecting that the temperature of the discharge air stream through the cover channel portion 28 has reached a predetermined temperature of 65° C. which is higher than 50° C. at which mites or like noxious small organisms are killed. and the synthetic resin forming the cleaner body remains free of thermal deformation or like thermal influence at the predetermined temperature.

The temperature sensor switch 36, although provided in the cover channel portion 28 in the present embodiment, may alternatively be provided on the side wall of the dust chamber 4, with the reset button projecting from the lower case member 1*b*.

Indicated at 38 is a limit switch attached to the rear side of the outer cover member 17 and opposed to the edge of the suction opening portion 21. When the shutter plate 25 closes the upper end of the hose socket 24, the front end of the shutter plate 25 comes into contact with the limit switch 38 to actuate the switch 38 and energize to the fan 7 through the temperature sensor switch 36.

Figure 6:
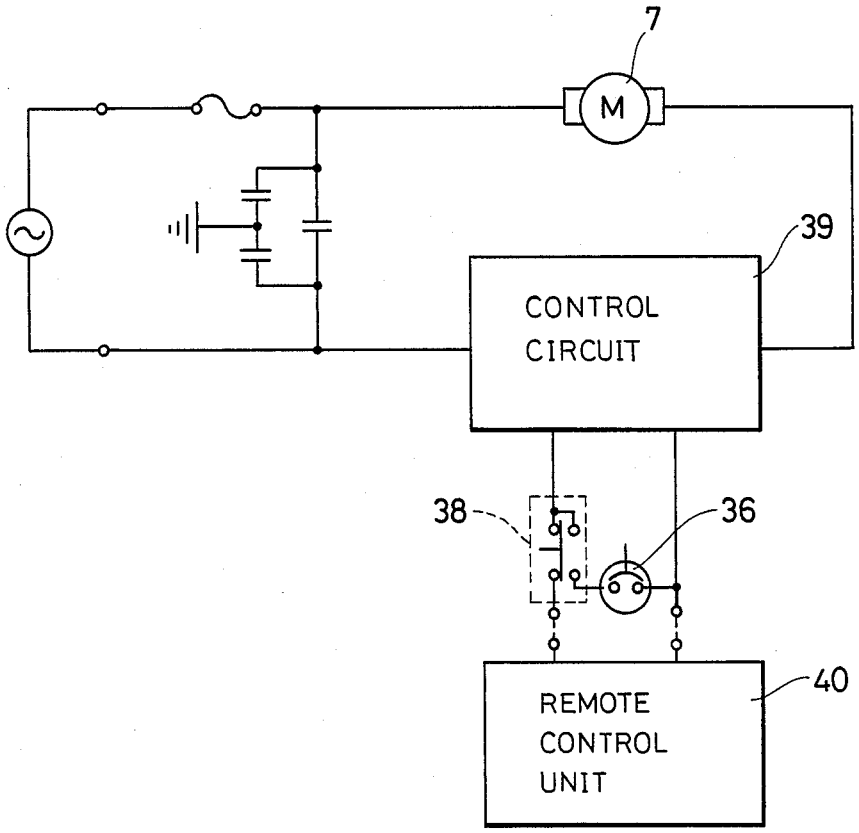

With reference to the electric circuit diagram of FIG. 6, indicated at 39 is a control circuit, and at 40 a remote control unit mounted on a handle pipe of the suction hose 22.

For a cleaning operation, the connection tube 22*a* of the suction hose 22 is inserted into the socket 24 with the shutter plate 25 opened as seen in FIG. 4. In this state, the air outlet 30 of the cover channel portion 28 is closed with the connection tube 22*a*, with the result that the discharge air from the fan 7 is discharged from the discharge opening 5 without circulating through the dust chamber 4. Accordingly, mites and like noxious small organisms are drawn in through the suction hose 22 along with dust and collected in the paper bag filter 14 within the dust chamber 4.

To operate the cleaner for killing the mites and like small noxious organisms after the completion of cleaning, the shutter plate 25 is closed as seen in FIG. 1, whereby the limit switch 38 is actuated. Subsequently, the reset button 37 is depressed, turning on the temperature sensor switch 36 to energize to the fan 7 for rotation. With the suction opening portion 21 closed with the shutter plate 25 at this time, a negative pressure is produced in the dust chamber 4, causing the discharge air from the fan 7 to flow into the chamber 4 through the body channel portion 29 and the cover channel portion 28. The air thus flows repeatedly in circulation and is heated with the heat released from the fan 7 to heat the dust chamber 4. The discharge air stream is therefore heated to a temperature higher than 50° C. to kill the mites and like noxious small organisms collected in the bag filter 14. Upon the temperature reaching 65° C., the sensor switch 36 is turned off to stop the fan and complete the organism killing operation.

With the vacuum cleaner C described above, the discharge air from the fan is circulated through the dust chamber via an air flow channel provided in the cleaner body, with the suction opening of the dust chamber closed, so that the mites and like noxious organisms trapped in the dust chamber can be easily controlled using only the arrangement provided in the cleaner body. Since the air channel permits the fan chamber to communicates directly with the dust chamber, the discharge air can be circulated over a shorter distance than in the conventional cleaner which employs the elongated suction hose, efficiently heating the interior of the dust chamber within a shorter period of time to completely kill the noxious organisms. Furthermore, the temperature sensor acts to automatically stop the fan so as not to overheat the discharge air, consequently rendering the cleaner body free of thermal deformation or like thermal influence to assure safety.

(2) Another vacuum cleaner embodying the invention will be described below with reference to FIGS. 7 to 15.

The cleaner 100C has a body case 101 which basically has the same construction as the case of the foregoing embodiment and therefore will not be described.

Figure 11:
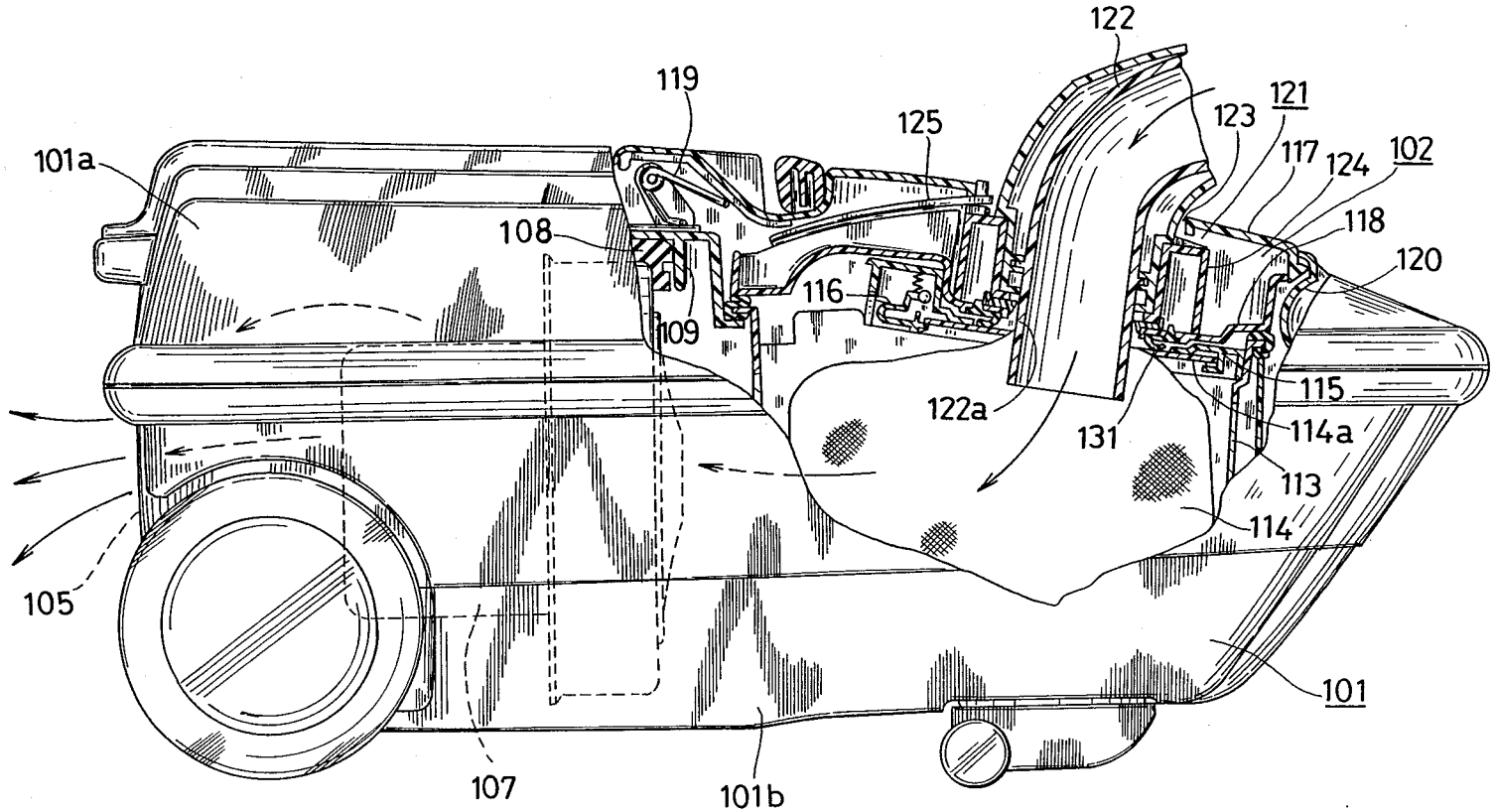
Figure 12:
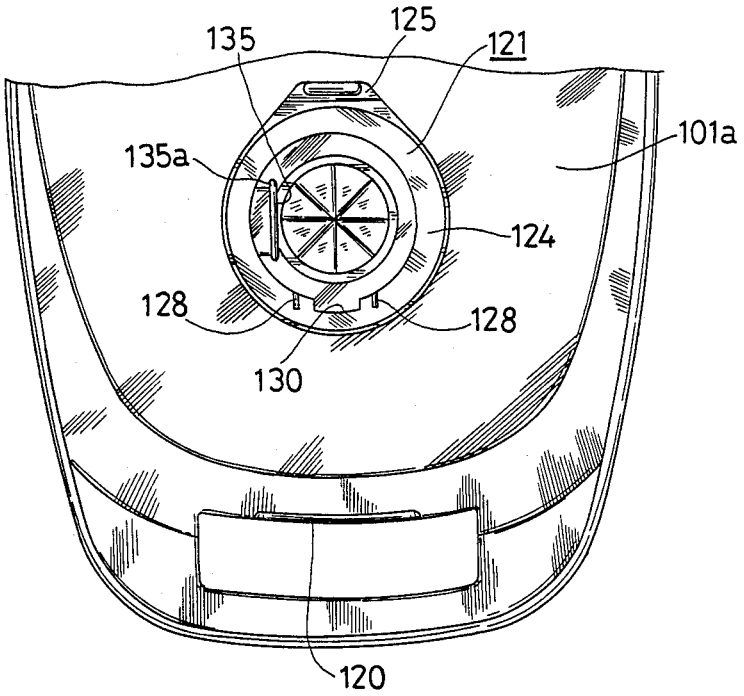
Figure 13:
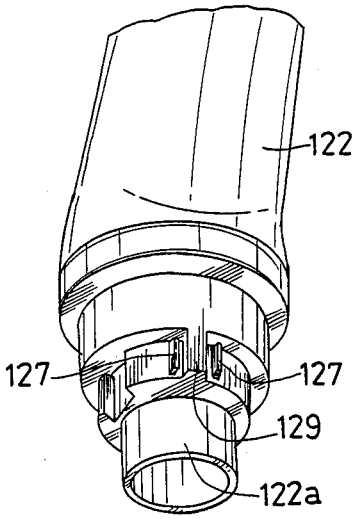
Figure 14:
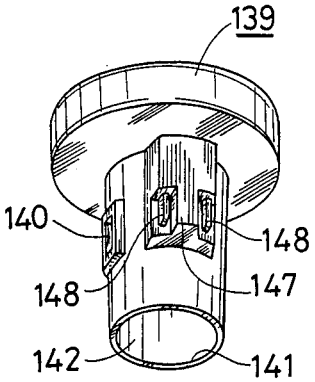
Figure 15:
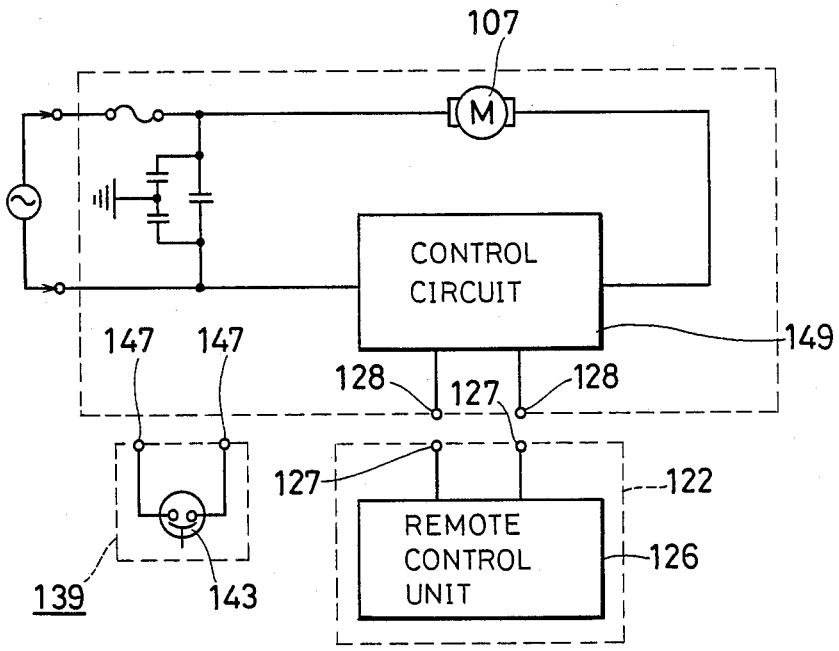

The cover 102 has a suction opening portion 121 for connection to a suction hose 122 (see FIG. 11). The opening portion 121 has a suction opening 123 formed in the outer cover member 117 and comprises a hose socket 124 postioned under the opening 123 and interposed between the upper and inner cover members 117, 118, and a slidable sutter plate 125 for openably closing the upper end of the hose socket 124. With reference to FIGS. 11 and 13 to 15, the hose socket 124 is provided with a pair of remote control sockets 128, 128 which are electrically connected to remote control terminals 127, 127 when a connection tube 122*a* of the hose 122 is inserted into the socket 124, and with a recess 130 for a projection 129 on the tube 122*a* to fit in for positioning the tube (see also FIG. 12). The terminals 127 are connected to a remote control unit 126 on a bent pipe (not shown) of the hose 122 for controlling the fan 107. A packing 131 is hermetically in pressing contact with the opening plate 114*a*.

Figure 10:
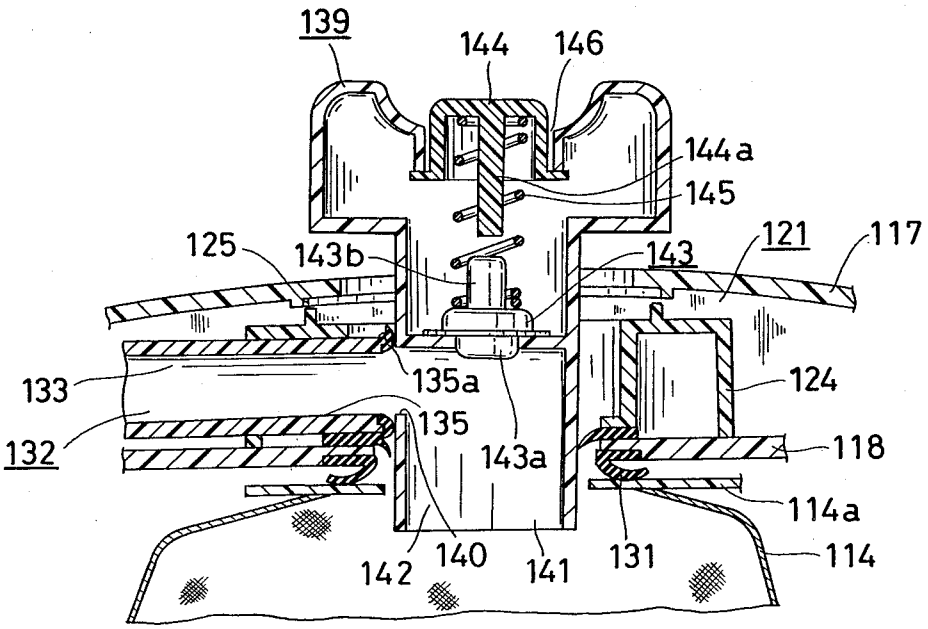

Indicated at 132 is an air channel provided within the cleaner body, whereby a discharge air stream from the fan 107 is circulated through the dust chamber 104. The air channel 132 comprises a cover channel portion 133 and a body channel portion 134. The cover channel portion 133 is provided between the outer and inner cover members 117, 118, and has one end communicating with an air outlet 135 formed in a side portion of the hose socket 124. The other end of the channel portion 133 is projected from the rear end of the cover 102 opposed to a portion of the body case 101 to provide an air inlet 136. The air outlet 135 is closed when the connection tube 122*a* of the suction hose 122 is inserted in the socket 124 as seen in FIG. 10, whereas the outlet 135 is left open when the tube 122*a* is not inserted.

The body channel portion 134, which is provided in the body case 101, extends from the discharge side 112 of the fan 107 forward through the upper support rib 109 and has an air outlet 137 in the body portion opposed to the air inlet 136. The air inlet 136 is provided with a seal packing 138 which, when the cover 102 is closed, seals off the junction between the inlet 136 and the outlet 137, hermetically holding these portions in communication with each other.

To kill noxious small organisms such as mites, a plug member 139 serving as closure means is removably fittable to the suction opening portion 121 as an attachment member in place of the connection tube 122*a*. The plug member 139 has a communication channel 142 provided with a lower bottom opening 141 and a side opening 140 communicating with the air outlet 135, with a packing 135*a* provided between the plug member and the outlet portion. A temperature sensor switch 143 is mounted on an upper bottom 142*a* of the plug member 139 and has a sensor portion 143*a* exposed to the communication channel 142 and a reset button 144. The reset button 144 is biased by a spring 145 so as to project upward through a hole 146 in the top of the plug member 139 and has a push pin 144*a* opposed to an actuating button 143*b* of the switch 143. The sensor switch 143 is turned on by depressing the reset button 144 and is turned off upon the sensor portion 136*a* detecting that the temperature of the discharge air through the communication channel 142 has reached a predetermined temperature of 65° C. which is higher than 50° C. at which mites or like noxious small organisms are killed. The synthetic resin forming the cleaner body remains free of thermal deformation or like thermal influence at the predetermined temperature. The peripheral wall of the plug member 139 defining the channel 142 is provided with a projection 147 for positioning the channel 142 in place when the plug member is inserted into the socket 124 and with a pair of switch terminals 148, 148 connected to the sensor switch 143. The projection 147 is fitted in the recess 130 of the hose socket 124, and the switch terminals 148 are electrically connected to the remote control sockets 128.

Figure 9:
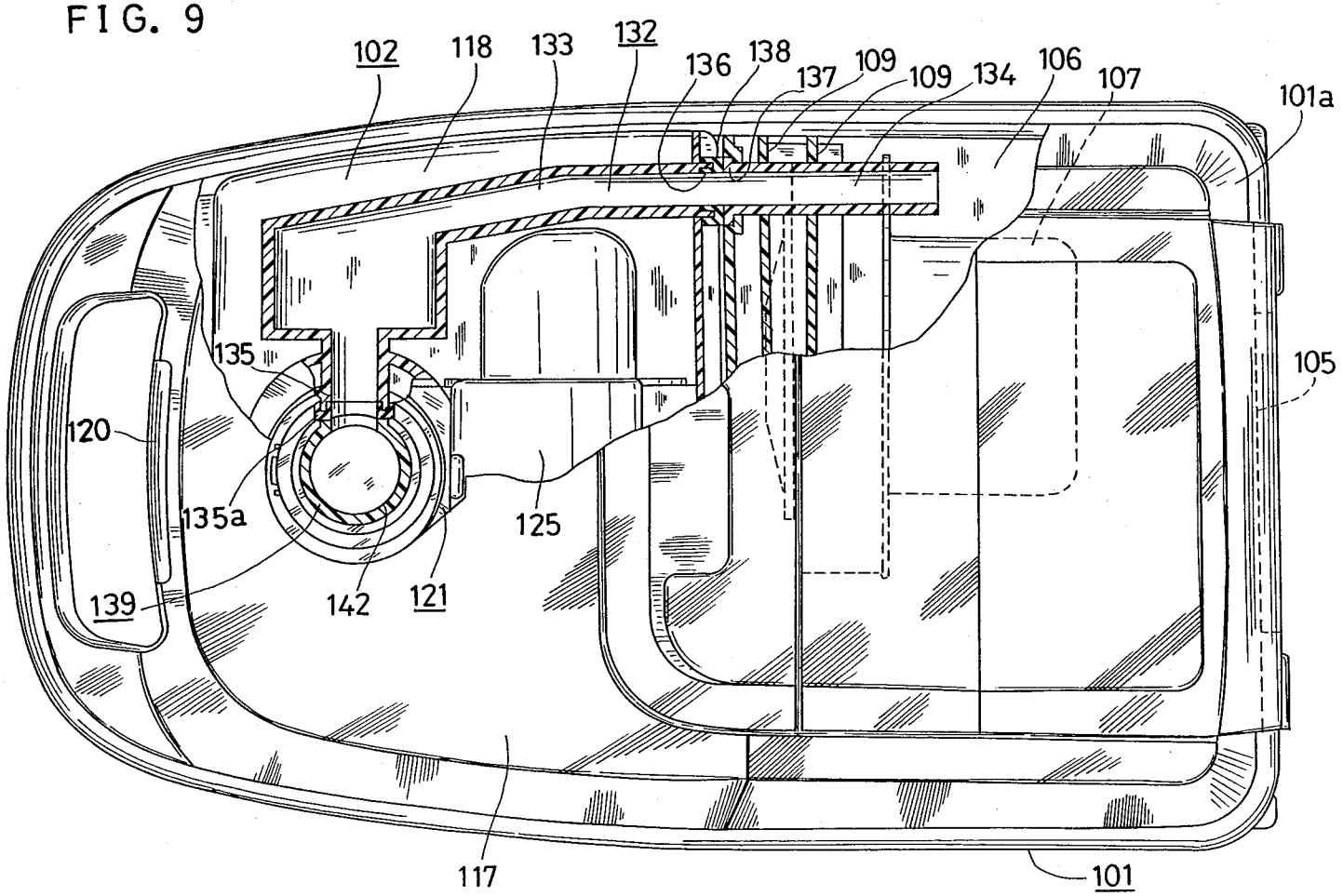

For a cleaning operation, the shutter plate 125 is opened, and the connection tube 122*a* of the suction hose 122 is inserted into the socket 124 as illustrated in FIGS. 9 and 11. In this state, the air outlet 135 of the cover channel portion 133 is closed with the connection tube 122*a*, so that the discharge air from the fan 107 is discharged from the discharge opening 105 without circulating through the dust chamber 104. Accordingly, mites and like noxious organisms are drawn in through the suction hose 122 along with dust and collected in the paper bag filter 114 within the dust chamber 104.

Figure 7:
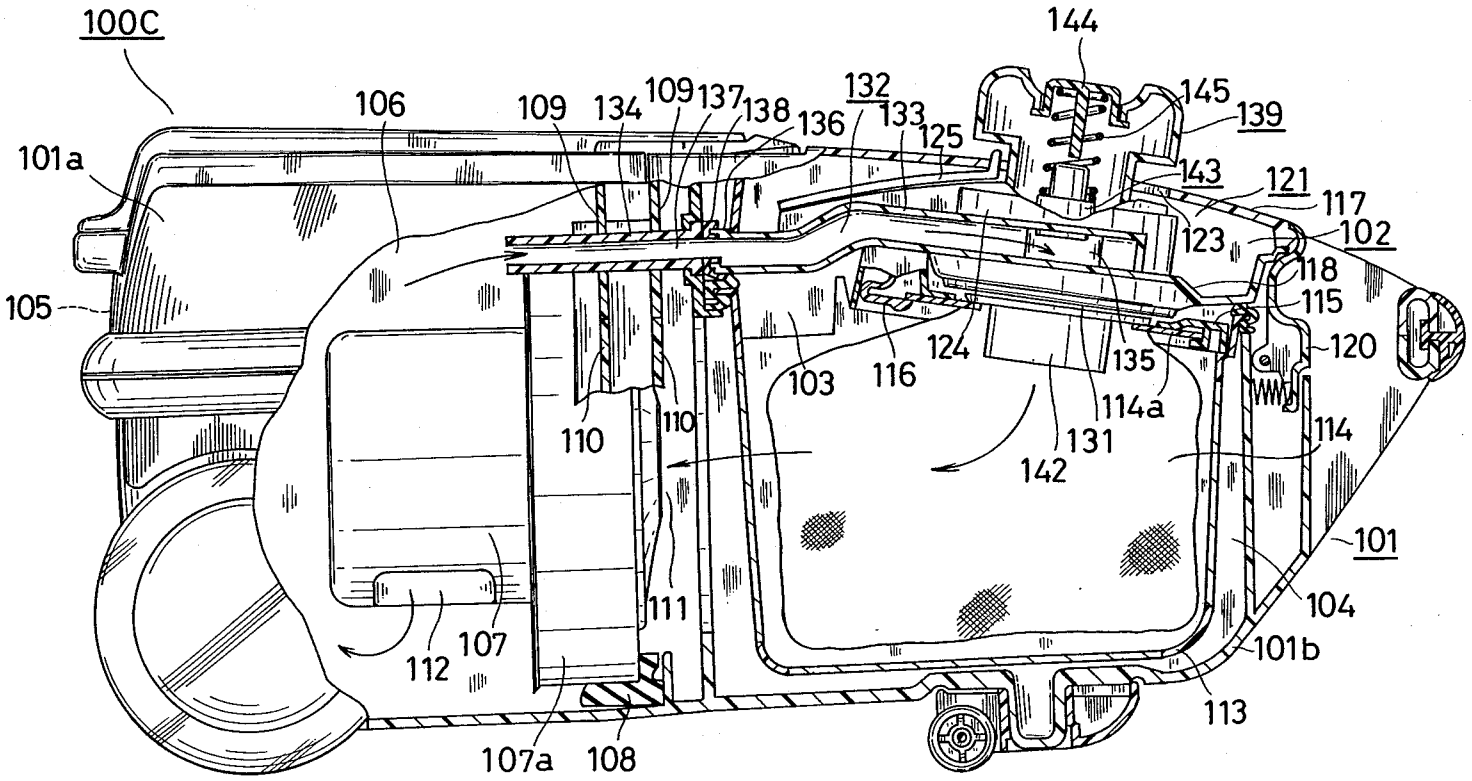
FIGS. 7 to 15 show another vacuum cleaner embodying the invention.
Figure 8:
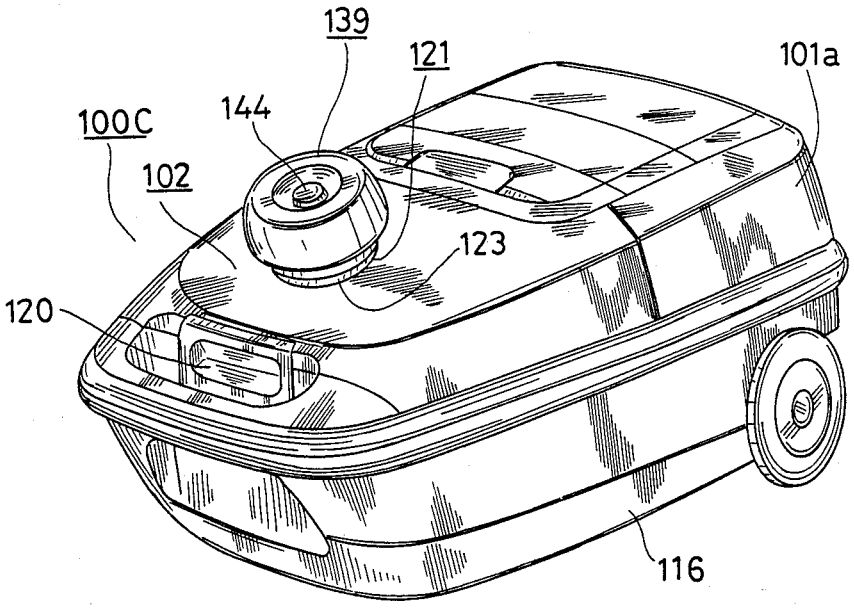

To operate the cleaner for killing the mites and like noxious small organisms after cleaning, the connection tube 122*a* is removed from the hose socket 124, and the channel portion 142 of the plug member 139 is inserted into the socket 124 as seen in FIGS. 7 and 10. Subsequently, the reset button 144 is depressed, turning on the temperature sensor switch 143 to supply power to the fan 107 for rotation, whereupon a negative pressure is created in the dust chamber 104, causing the discharge air from the fan 107 to flow into the chamber 104 through the body channel portion 134 and the cover channel portion 133. The air thus flows repeatedly in circulation and is heated with the heat released from the fan 107 to heat the dust chamber 104. The discharge air stream is therefore heated to a temperature higher than 50° C. to kill the mites and like organisms collected in the bag filter 114. Upon the temperature of the air stream reaching 65° C., the temperature sensor switch 143 is turned off to stop the fan 107.

With the vacuum cleaner 100C described above, the discharge air from the fan is circulated through the dust chamber via an air channel provided in the cleaner body, and a plug member as an attachment member, is removably fittable to the suction opening portion of the dust chamber to cause the air channel to communicate with the dust chamber via a communication channel in the plug member. Accordingly, the mites and like noxious small organisms trapped in the dust chamber can be easily killed merely by attaching the plug member to the cleaner body. Since the dust chamber is adapted to communicate with the fan chamber through the air channel and the communication channel within the cleaner body, the discharge air can be circulated over a shorter distance than in the prior art in which the elongated suction hose is used, consequently heating the interior of the dust chamber efficiently and rapidly to completely kill the noxious organisms. Furthermore, the temperature sensor switch automatically stops the fan so as not to overheat the discharge air, thereby rendering the cleaner body free of thermal influence such as thermal deformation to assure safety.

Although a temperature sensor switch is used in the foregoing embodiments (1) and (2) for automatically stopping the electric fan in the organism killing operation, a timer switch is alternatively usable for automatically bringing the fan out of operation upon lapse of a specified time interval, e.g. 2 to 6 minutes.

(3) Another vacuum cleaner embodying the invention will be described with reference to FIGS. 16 to 22.

Figure 16:
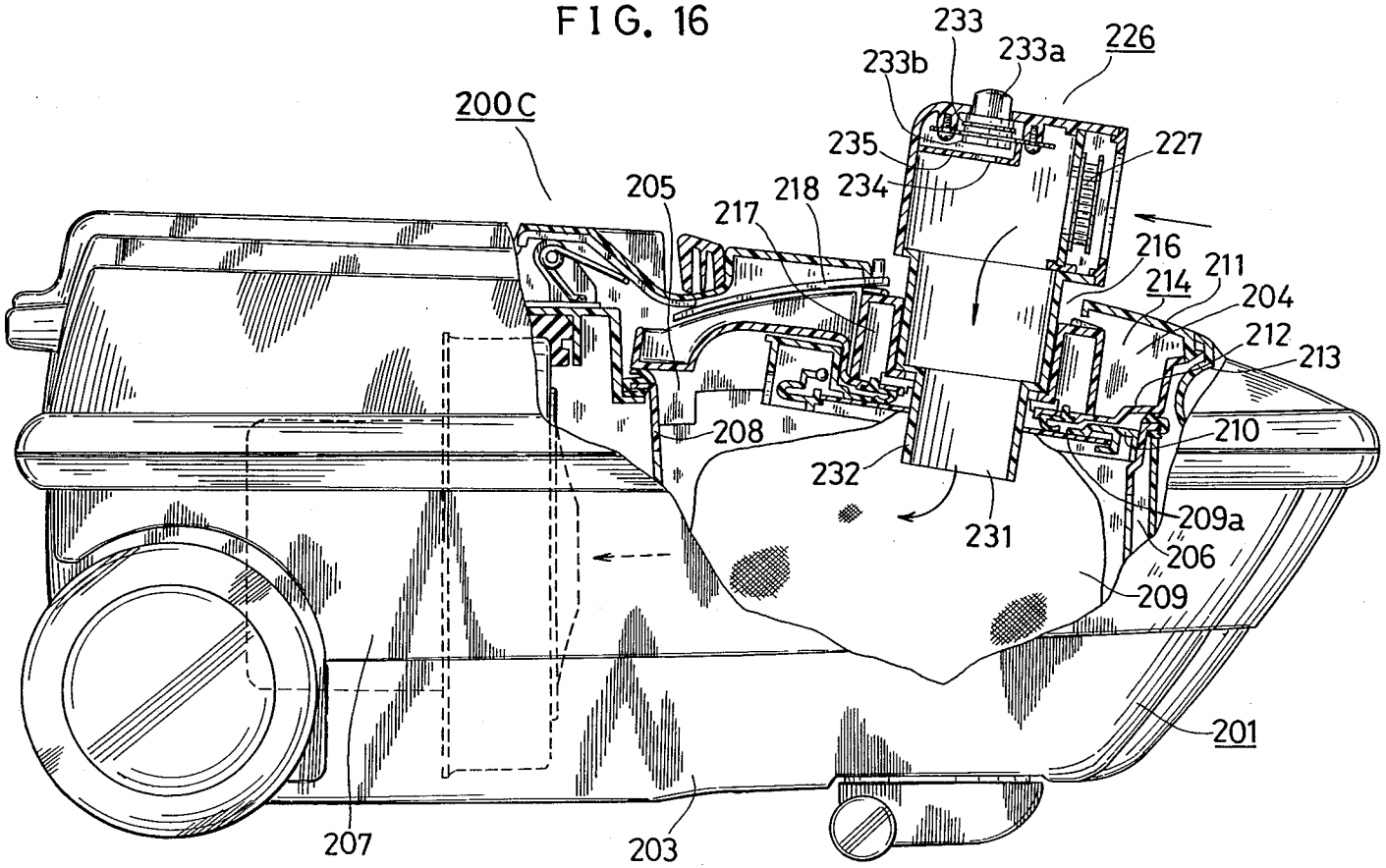
FIGS. 16 to 22 show another vacuum cleaner embodying the invention.
Figure 17:
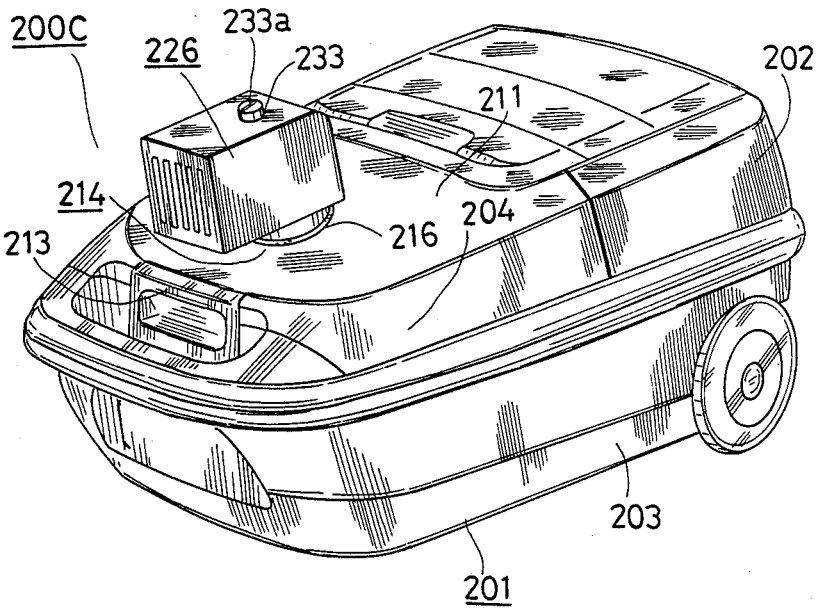

Referring to FIGS. 16 and 17, the vacuum cleaner 200C has a canister-type cleaner body 201 comprising an upper case member 202 and a lower case member 203. The body has in its front portion a dust chamber 206 formed with an upper opening 105 which is closed with a cover 204, and in its rear portion an electric fan 207 the suction side of which is in communication with the dust chamber 206.

A box-shaped filter 208 having air permeability and shape retentivity to serve as a dust collecting filter is accommodated in the dust chamber 206 and is removable through the upper opening 205. The filter 208 has removably accommodated therein a disposable paper bag filter 209 serving also as a dust collecting filter which comprises a paper bag having air permeability but not permitting passage of noxious small organisms such as mites therethrogh. Indicated at 210 is a frame for holding an opening plate 209*a* of the bag filter 209. The holding frame 210 rests on the opening edge of the box-shaped filter 208.

The cover 204 has a double-wall structure comprising an outer cover member 211 and an inner cover member 212. The cover has a rear portion pivoted to the upper case member 202 and a front portion engaged by a clamp member 213 provided on the lower case member 203 to hold the upper opening 205 closed.

Figure 21:
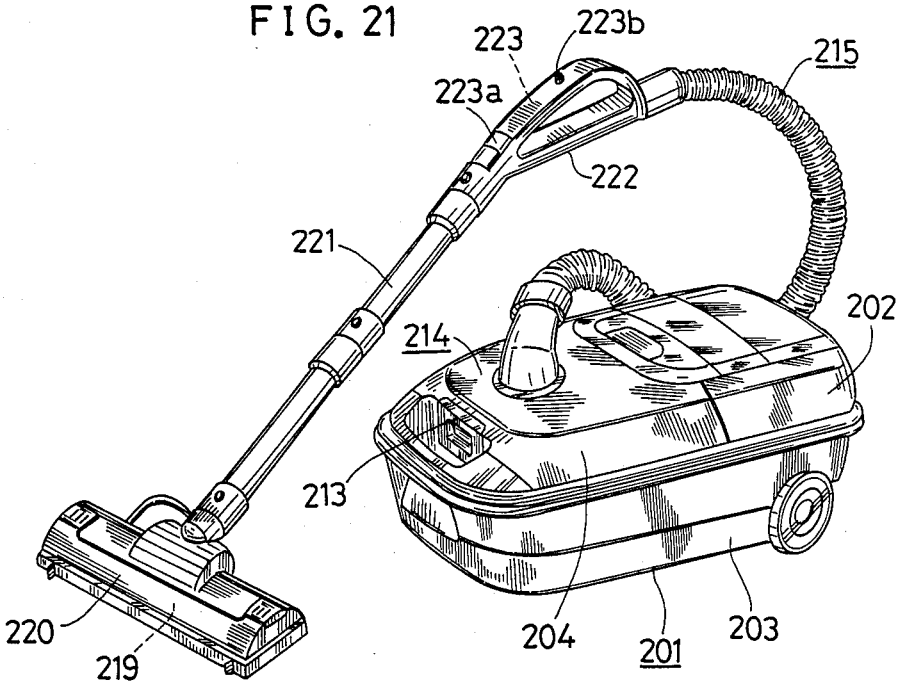
Figure 22:
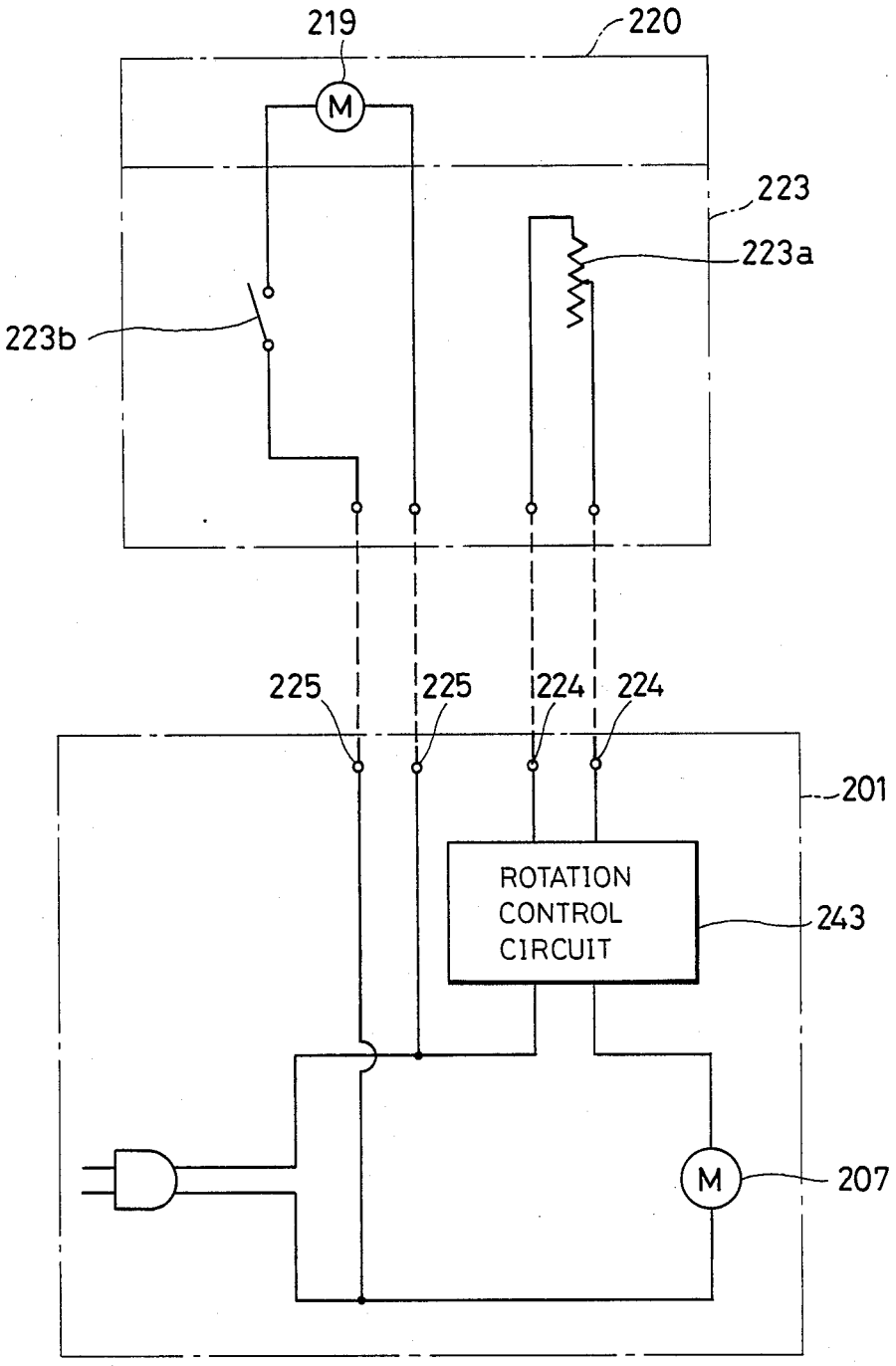
Figure 24:
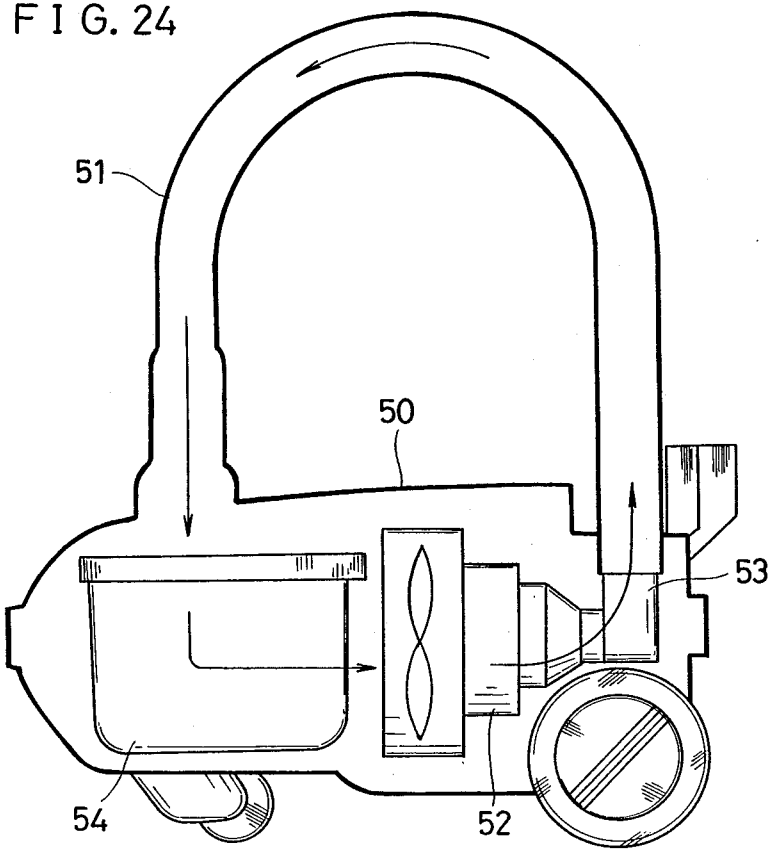
FIG. 24 is a sectional view schematically showing a conventional vacuum cleaner.

The cover 204 is provided with a suction opening portion 214 for connecting a suction hose 215 (see FIG. 21) to the cleaner 200C. The opening portion 214 has a suction opening 216 formed in the outer cover member 211 and comprises a hose socket 217 positioned under the opening 216 and interposed between the outer and inner cover members 211, 212, and a slidable shutter plate 218 for openably closing the upper end of the hose socket 217. With reference particularly to FIGS. 21 to 22, the suction hose 15 has connected thereto by an extension tube 221 electric suction means 220 for use on floors which means includes a rotary brush rotatable by an electric motor 219. A bent pipe 222 at the forward end of the suction hose 215 has accommodated therein a remote control unit 223 which has a variable resistor 223*a* and a brush switch 223*b* serving as a cleaning operation switch, whereby the fan 207 is on-off controlled and has its number of revolutions controlled, and the electric motor 219 is on-off controlled. The hose socket 217 has a pair of remote control terminals 224, 224 for electrical connection to the remote control unit 223, and a pair of terminals 225, 225 for supplying power to the motor 219 in the suction means 220 from a commercial 100-V power source.

Figure 18:
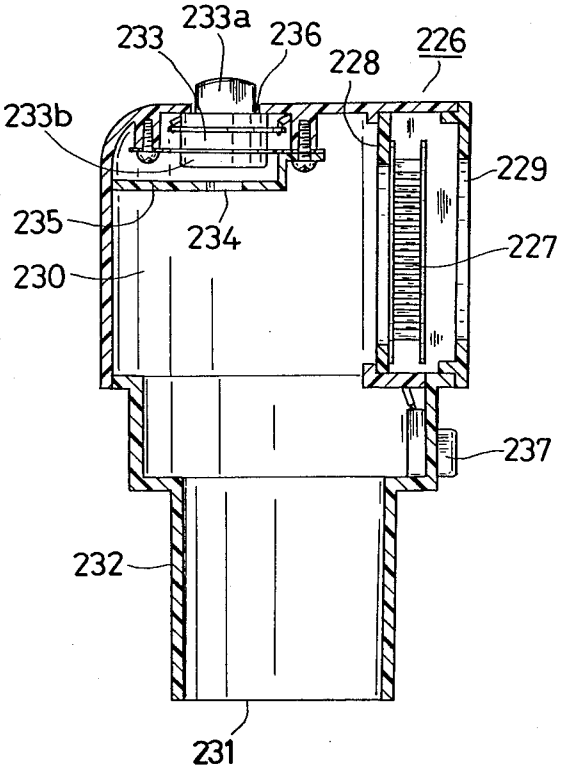
Figure 18:
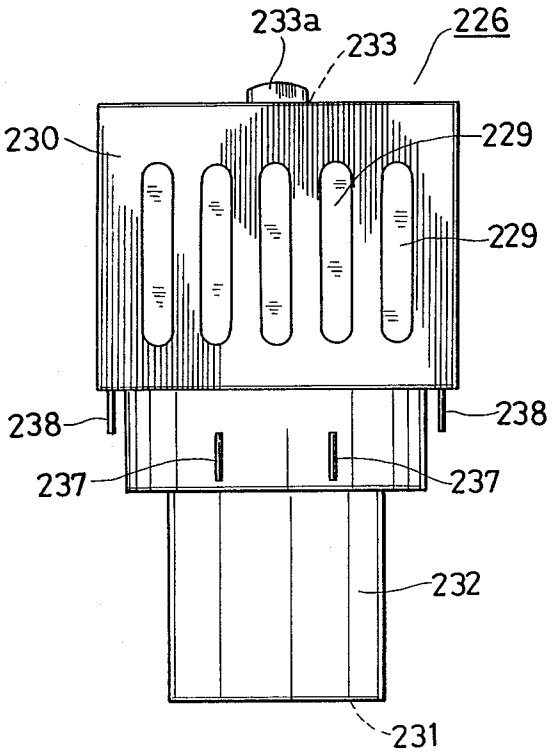

Indicated at 226 is a hot air supply unit removably fittable to the suction opening portion 214 as an attachment member. With reference to FIGS. 18 (*a*) and (*b*), the unit 226 comprises a heating tube 230 serving as a tubular member and housing a heater 227, such as thermistor having positive temperature characteristics, attached to a mount plate 228, the tube 230 having air intake apertures 229 in its front side. The unit 226 further comprises a spigot 232 extending downward from the heating tube 230, having a hot air outlet 231 at its lower end and fittable in the hose socket 217. A temperature sensor switch 233 attached to the top wall of the heating tube 230 is covered with a shelter plate 235 formed with an air port 234. The sensor switch 233 has a reset button 233*a* projecting outward from the unit 226 through a top hole 236 of the heating tube 230. The switch 233 is turned on when the reset button 233*a* is depressed and is heated through the shelter plate 235 with hot air flowing through the heating tube 230. The sensor switch 233 is turned off when the sensor portion 233*b* thereof detects that the temperature of the hot air has reached a predetermined level, e.g. 70° C., which is beyond 50° C., i.e. the temperature at which mites and like noxious organisms are killed, and which will not thermally deform or otherwise thermally influence the synthetic resin forming the cleaner body. Since the shelter plate 235 prevents the flow of hot air from coming into direct contact with the sensor switch 233, the time taken for the switch 233 to reach the predetermined temperature is lengthened by a specified time interval (e.g. about 1 to 2 minutes), whereby the switch 233 is adapted to operate like a timer. The hot air supply unit 226 further has a pair of secondary terminals 237, 237 electrically connectable to the pair of remote control terminals 224, 224, and a pair of heater terminals 238, 238 electrically connectable to the pair of power supply terminals 225, 225. These secondary terminals 237 and the heater terminals 238 are left exposed outside the unit 226.

Figure 19:
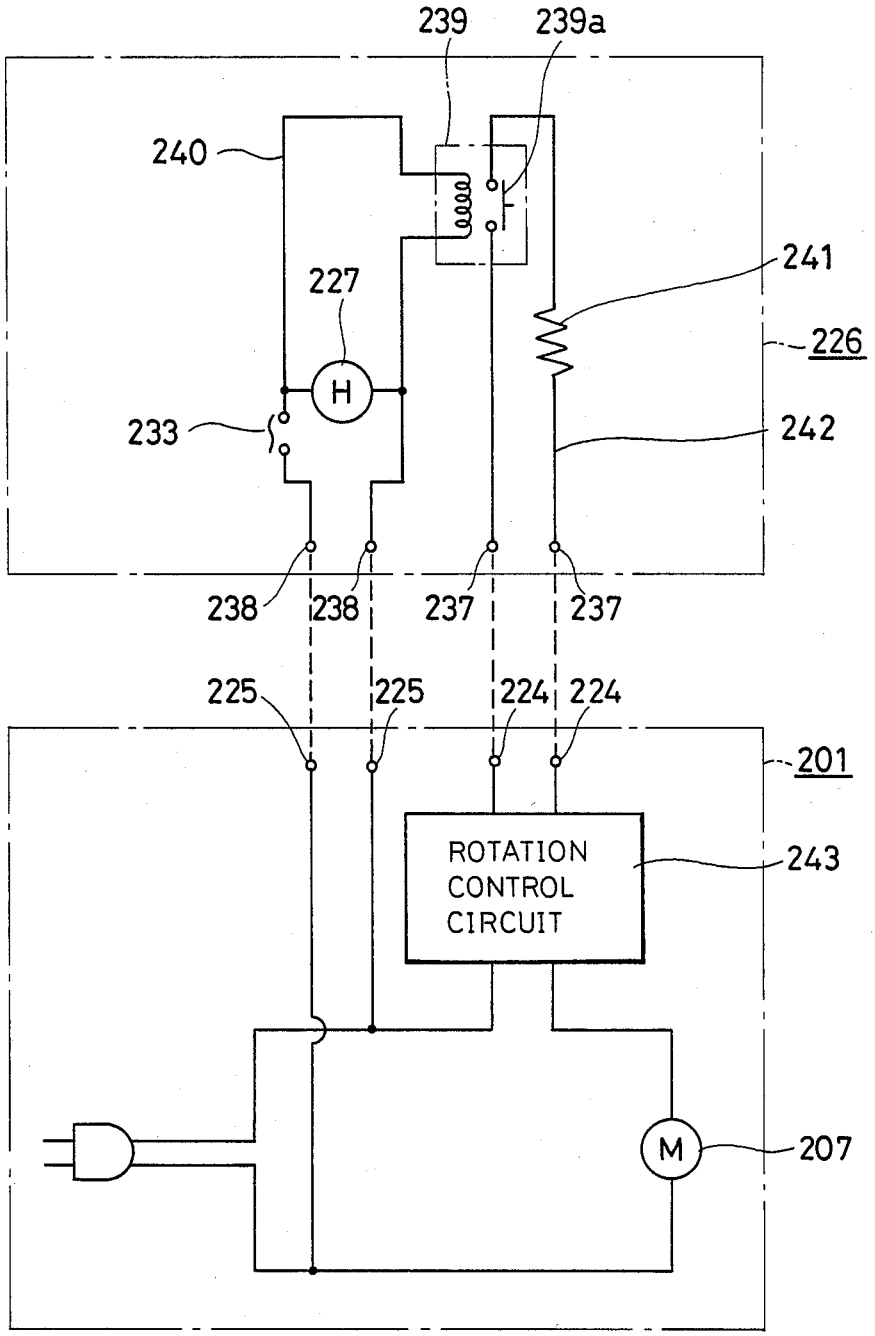
Figure 20:
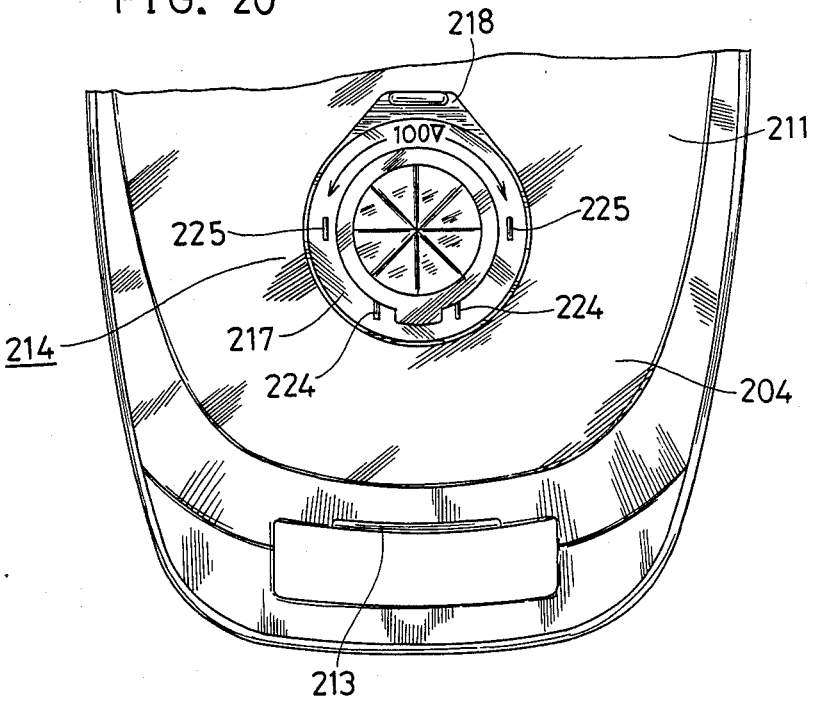

With reference to FIG. 19 showing the electric circuit of the cleaner when the unit 226 is fitted to the socket 217, the unit 226 includes a heater circuit 240 for connecting a parallel circuit of the heater 227 and a relay 239 to the heater terminals 238, 238 via the temperature sensor switch 233, and a control circuit 242 for connecting a series circuit of a normally closed contact 239*a* of the relay 239 and a resistor 241 to the secondary terminal 237, 237. The cleaner body 201 include a revolution control circuit 243 serving as a power supply circuit for the fan 207 and connected to the remote control terminals 224, 224. The resistor 241 is controlled along with the heater 227 by the switch 233 to control the revolution control circuit 243, thereby reducing the number of revolutions of the fan 207 and diminishing the suction force, whereby the velocity of hot air to be supplied to the dust chamber 206 from the unit 226 is decreased. Thus, the resistor 241 serves as means for reducing number of revolutions. The resistor 241 and the relay 239 are arranged on the side face of the temperature sensor switch 233.

When the cleaner is to be operated for cleaning, the connection tube of the suction hose 215 is inserted into the hose socket 217, and the remote control unit 223 is manipulated to on-off control the fan 207, control the number of revolutions thereof and on-off control the motor 219 of the suction means 220. The mites and like noxious small organisms drawn in through the hose 215 along with dust are collected in the bag filter 209 in the dust chamber 206.

To operate the cleaner for controlling the organisms after cleaning, the spigot 232 of the hot air supply unit 226 is fitted into the hose socket 217 in place of the connection tube of the suction hose 215, and the reset button 233*a* is depressed, whereby the temperature sensor switch 233 is turned on to supply commercial 100-V power to the heater 227 and the relay 239 through the power supply terminals 225, 225. The heater 227 is immediately heated. With the relay 239 thus energized, the resistor 241 is connected to the rotation control circuit 243 through the remote control terminals 224, 224, which in turn rotates the fan 207 at a reduced number of revolutions to give a decreased suction force to draw hot air having a temperature of about 70° C. through the heater 227 into the dust chamber 206 via the suction opening portion 217 at a low rate. Consequently, the interior of the dust chamber 206 is heated to above 50° C to kill the mites and like noxious small organisms trapped in the bag filter 209. Upon lapse of a specified period of time, the switch 233 reaches the predetermined temperature (70° C.), whereupon the switch 233 is turned off to turn off the heater 227 and stop the fan 207, whereby the controlling operation is completed.

Figure 23:
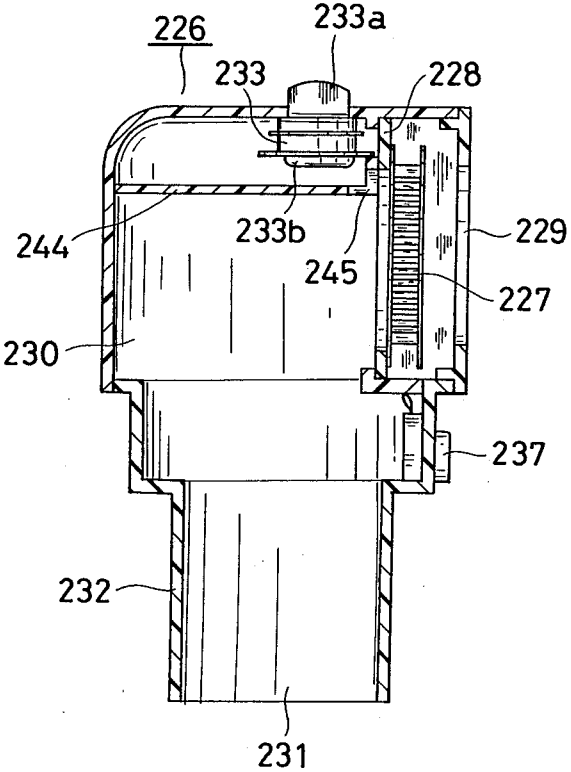
FIG. 23 is a view corresponding to FIG. 18 (*b*) and showing another hot air supply unit embodying the invention.

FIG. 23 shows another hot air supply unit embodying the invention and different from the corresponding unit of the above embodiment. Indicated at 244 in the drawing is a shelter plate covering the top wall of the unit 226 and having one end bearing on a mount plate 228, and at 245 an air port opposed to the mount plate 228. This embodiment is so adapted that hot air easily flows into contact with a temperature sensor switch 233 through the air port 245 in the shelter plate 244 when the flow rate of hot air greatly decreases, for example, owing to the clogging of the paper bag filter 209, whereby the switch 233 is immediately turned off to preclude the thermal deformation of the cleaner body 201 or the hot air supply unit 226.

With the vacuum cleaner 200C described above, a hot air supply unit as an attachment member is provided with a heater and a temperature sensor switch, so that merely by attaching the unit to the cleaner body, power can be supplied to the heater through supply terminals to cause hot air to flow into the dust chamber, whereby the mites and like noxious small organisms trapped in the chamber can be readily killed. Further since the hot air flows into the dust chamber directly from the unit, the orgnisms can be killed completely more rapidly and more efficiently than in the prior art wherein the long suction hose is used. The temperature sensor switch automatically turns off the heater, rendering the cleaner body or the hot air supply unit free of thermal deformation or like thermal influence to assure safety.

Although a temperature sensor switch is used in the above embodiment (3) for automatically turning off the fan and the heater in the organism killing operation, a timer switch is alternatively usable for automatically stopping the operation of the fan and the heater upon lapse of a specified time interval, e.g. 2 to 6 minutes.

What is claimed is:

1. A vacuum cleaner comprising a cleaner body having a dust chamber formed with a suction opening and a fan chamber communicating with the dust chamber and accommodating an electric fan therein, the fan chamber having an air discharge opening, and drive control means for controlling the operation of the fan, the cleaner body being provided with an air channel in its interior for holding a portion of the fan chamber at the air discharge side of the fan in communication with the dust chamber and closure means for closing the suction opening of the dust chamber, the drive control means comprising cleaning operation means for driving the fan to thereby draw dust collecting air into the suction opening, pass the air through the dust chamber and the fan chamber and discharge the air from the discharge opening for a cleaning operation, and organism killing operation means for driving the fan after the cleaning operation to cause air to flow through the dust chamber, the fan chamber and the air channel into the dust chamber in circulation by the action of the closure means and kill noxious small organisms in the dust trapped in the dust chamber by heating.

2. A vacuum cleaner as defined in claim 1 wherein the organism killing operation means has a temperature sensor switch for automatically stopping the operation of the fan upon the internal temperature of the dust chamber reaching a predetermined level.

3. A vacuum cleaner as defined in claim 2 wherein the closure means is a plug member fittable into the suction opening to close the suction opening, and the temperature sensor switch is attached to the plug member.

4. A vacuum cleaner as defined in claim 1 wherein the organism killing operation means has a timer switch for automatically stopping the operation of the fan upon lapse of a specified period of time.

5. A vacuum cleaner as defined in claim 1 wherein the closure means is a shutter plate slidable across the suction opening to close the suction opening.

6. A vacuum cleaner as defined in claim 1. wherein the closure means is a plug member fittable into the suction opening to close the suction opening.

7. A vacuum cleaner as defined in claim 1 wherein the cleaner body is removably provided with a dust collecting filter in the dust chamber.

8. A vacuum cleaner as defined in claim 7 wherein the dust collecting filter is a paper bag filter.

9. A vacuum cleaner comprising a cleaner body having a dust chamber formed with a suction opening and a fan chamber communicating with the dust chamber and accommodating an electric fan therein, the fan chamber having an air discharge opening, a hot air supply unit fittable to the suction opening for supplying hot air to the dust chamber, and drive control means for controlling the operation of the fan and the hot air supply unit, the drive control means comprising cleaning operation means for driving the fan to thereby draw dust collecting air into the suction opening, pass the air through the dust chamber and the fan chamber and discharge the air from the discharge opening for a cleaning operation, and organism killing operation means for driving the hot air supply unit as fitted to the suction opening after the cleaning operation to supply hot air to the interior of the dust chamber and kill noxious small organisms in the dust trapped in the dust chamber by heating.

10. A vacuum cleaner as defined in claim 9 wherein the cleaning operation means comprises a power supply circuit for driving the fan and a cleaning operation switch for energizing and deenergizing the circuit, and the hot air supply unit comprises a tubular member fittable to the suction opening for guiding outside air into the dust chamber and a heater disposed within the tubular member, the organism killing operation means comprising said power supply circuit electrically connectable to the heater when the tubular member is fitted to the suction opening, an organism killing operation switch for energizing the power supply circuit to drive the fan and the heater, and an automatic stop switch for automatically deenergizing the power supply circuit.

11. A vacuum cleaner as defined in claim 10 wherein the automatic stop switch is a temperature sensor switch for automatically deenergizing the power supply circuit upon the internal temperature of the dust chamber reaching a predetermined level.

12. A vacuum cleaner as defined in claim 10 wherein the automatic stop switch is a timer switch for automatically deenergizing the power supply circuit upon lapse of a specified period of time.

13. A vacuum cleaner as defined in claim 10 wherein the automatic stop switch is a temperature sensor switch for automatically deenergizing the power supply circuit upon the internal temperature of the dust chamber reaching a predetermined level, and the temperature sensor switch and the organism killing operation switch are in the form of a single switch means provided on the tubular member.

14. A vacuum cleaner as defined claim 10 wherein the power supply circuit further has means for reducing the number of revolutions of the fan when the hot air supply unit is fitted to the suction opening.

15. A vacuum cleaner as defined in claim 10 wherein the cleaner body is removably provided with a dust collecting filter in the dust chamber.

16. A vacuum cleaner as defined in claim 15 wherein the dust collecting filter is a paper bag filter.

17. A vacuum cleaner as in claim 1 wherein during the killing operation the fan provides heat to the air which is conveyed from the fan chamber into the air channel for supply to the dust chamber to accomplish the killing of the organisms in the dust chamber.

18. A vacuum cleaner as in claim 17 wherein during the killing operation heated air withdrawn from the dust chamber by the fan into the fan chamber is further heated by the heat from the fan and supplied to the air channel.

* * * * *